US005967255A

United States Patent [19]

Young

[11] Patent Number: 5,967,255

[45] Date of Patent: Oct. 19, 1999

[54] STEP STOOL ATTACHMENT

[76] Inventor: Daniel D. Young, 3105 Brewton Dr., Plano, Tex. 75074

[21] Appl. No.: 09/199,106

[22] Filed: Nov. 25, 1998

[51] Int. Cl.[6] ..... E04G 3/00

[52] U.S. Cl. ..... 182/91; 297/14

[58] Field of Search ..... 182/91, 84, 35, 182/82; 297/14, 16.1, 17, 18; 248/240.2–240.4, 244, 243; 16/362, 271

[56] References Cited

U.S. PATENT DOCUMENTS

| | | | |
|---|---|---|---|
| 1,288,604 | 12/1918 | Jenkins | 182/91 |
| 1,355,055 | 10/1920 | Schechter | 297/14 |
| 3,136,386 | 6/1964 | Horvath et al. | 182/77 |
| 5,660,405 | 8/1997 | Campbell | 182/91 X |

*Primary Examiner*—Daniel P. Stodola
*Assistant Examiner*—Hugh B. Thompson

[57] ABSTRACT

A step stool attachment for attachment to vertical structures such as a wall or the inside of a cabinet door to permit users to reach higher locations. The step stool attachment includes a backboard designed for attachment to a vertical structure. A step is pivotally coupled to the front face of the backboard. Front and back leg panels are pivotally coupled to the lower face of the step. The bottom edge of each leg panel has a spaced apart pair of adjustable feet extending therefrom.

16 Claims, 2 Drawing Sheets

STEP STOOL ATTACHMENT

BACKGROUND OF THE INVENTION

1. Field of the Invention

The present invention relates to step stools and more particularly pertains to a new step stool attachment for attachment to vertical structures such as a wall or the inside of a cabinet door to permit users to reach higher locations.

2. Description of the Prior Art

The use of step stools is known in the prior art. More specifically, step stools heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,085,290 by Gurilinger; U.S. Pat. No. 2,581,488 by Keltner et al.; U.S. Pat. No. 3,311,190 by Nuamann; U.S. Pat. No. 5,014,818 by Schulz; U.S. Pat. No. 5,005,667 by Anderson; and U.S. Pat. No. Des. 260,683 by Kokska.

While these devices fulfill their respective, particular objectives and requirements, the aforementioned patents do not disclose a new step stool attachment. The inventive device includes a backboard designed for attachment to a vertical structure. A step is pivotally coupled to the front face of the backboard. Front and back leg panels are pivotally coupled to the lower face of the step. The bottom edge of each leg panel has a spaced apart pair of adjustable feet extending therefrom.

In these respects, the step stool attachment according to the present invention substantially departs from the conventional concepts and designs of the prior art, and in so doing provides an apparatus primarily developed for the purpose of attachment to vertical structures such as a wall or the inside of a cabinet door to permit users to reach higher locations.

SUMMARY OF THE INVENTION

In view of the foregoing disadvantages inherent in the known types of step stools now present in the prior art, the present invention provides a new step stool attachment construction wherein the same can be utilized for attachment to vertical structures such as a wall or the inside of a cabinet door to permit users to reach higher locations.

The general purpose of the present invention, which will be described subsequently in greater detail, is to provide a new step stool attachment apparatus and method which has many of the advantages of the step stools mentioned heretofore and many novel features that result in a new step stool attachment which is not anticipated, rendered obvious, suggested, or even implied by any of the prior art step stools, either alone or in any combination thereof.

To attain this, the present invention generally comprises a backboard designed for attachment to a vertical structure. A step is pivotally coupled to the front face of the backboard. Front and back leg panels are pivotally coupled to the lower face of the step. The bottom edge of each leg panel has a spaced apart pair of adjustable feet extending therefrom.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new step stool attachment apparatus and method which has many of the advantages of the step stools mentioned heretofore and many novel features that result in a new step stool attachment which is not anticipated, rendered obvious, suggested, or even implied by any of the prior art step stools, either alone or in any combination thereof.

It is another object of the present invention to provide a new step stool attachment which may be easily and efficiently manufactured and marketed.

It is a further object of the present invention to provide a new step stool attachment which is of a durable and reliable construction.

An even further object of the present invention is to provide a new step stool attachment which is susceptible of a low cost of manufacture with regard to both materials and labor, and which accordingly is then susceptible of low prices of sale to the consuming public, thereby making such step stool attachment economically available to the buying public.

Still yet another object of the present invention is to provide a new step stool attachment which provides in the apparatuses and methods of the prior art some of the advantages thereof, while simultaneously overcoming some of the disadvantages normally associated therewith.

Still another object of the present invention is to provide a new step stool attachment for attachment to vertical structures such as a wall or the inside of a cabinet door to permit users to reach higher locations.

Yet another object of the present invention is to provide a new step stool attachment which includes a backboard designed for attachment to a vertical structure. A step is pivotally coupled to the front face of the backboard. Front and back leg panels are pivotally coupled to the lower face of the step. The bottom edge of each leg panel has a spaced apart pair of adjustable feet extending therefrom.

Still yet another object of the present invention is to provide a new step stool attachment that folds out of the way when not in use.

Even still another object of the present invention is to provide a new step stool attachment that may be placed on vanity doors underneath sinks or on cabinet doors beneath countertops so that children may stand thereon to reach the sink and cabinet.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
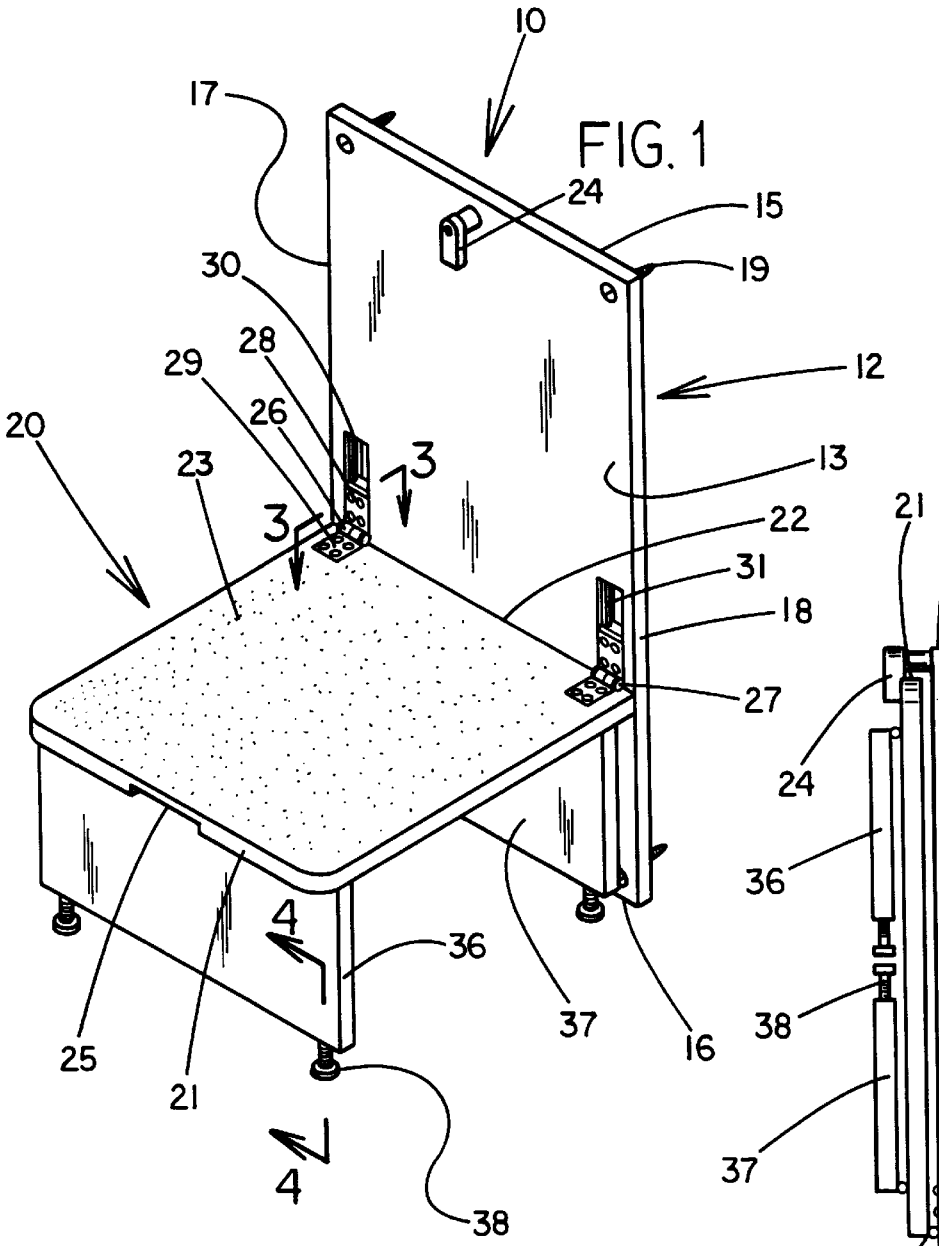
FIG. 1 is a schematic perspective view of a new step stool attachment according to the present invention with the step in the deployed position.

With reference now to the drawings, and in particular to FIGS. 1 through 4 thereof, a new step stool attachment embodying the principles and concepts of the present invention and generally designated by the reference numeral 10 will be described.

As best illustrated in FIGS. 1 through 4, the step stool attachment 10 generally comprises a backboard designed for attachment to a vertical structure. A step is pivotally coupled to the front face of the backboard. Front and back leg panels are pivotally coupled to the lower face of the step. The bottom edge of each leg panel has a spaced apart pair of adjustable feet extending therefrom.

In closer detail, the step stool attachment 10 is designed for attachment to a substantially vertical structure 11 such as a wall or the inside of a cabinet door. Specifically, the step stool attachment comprises a generally rectangular backboard 12 having generally rectangular and substantially planar front and back faces 13,14, generally straight upper and lower end edges15,16, and a pair of generally straight side edges 17,18 extending between the upper and lower end edges of the backboard. The end edges of the backboard are preferably extended substantially parallel to one another. The side edges of the backboard are preferably extended substantially parallel to one another and substantially perpendicular to the end edges of the backboard. The backboard has a thickness defined between the front and back faces of the backboard, a height defined between the end edges of the backboard and a width defined between the side edges of the backboard. The length of the backboard is greater than the width of the backboard.

In use, the back face of the backboard is designed for attachment to a vertical structure such that the end edges of the backboard are generally horizontal and the side edges of the backboard are generally vertical. Preferably, a plurality of threaded fasteners 19 are extended through the backboard and into the vertical structure to attach the backboard to the vertical structure. Ideally, each of the corners of the backboard has one of the fasteners positioned thereadjacent.

A generally rectangular step 20 has generally rectangular and substantially planar upper and lower faces, generally straight front and back end edges 21,22, and a pair of side edges extending between the front and back end edges of the step. The front and back end edges of the step are preferably extended substantially parallel to one another. Preferably, the side edges of the step are extended substantially parallel to one another and substantially perpendicular to the front and back end edges of the step. The step has a thickness defined between the upper and lower faces of the backboard, a length defined between the front and back end edges of the step and a width defined between the side edges of the step. The length of the step is greater than the width of the step. The length of the backboard is greater than the length of the step. The widths of the step and backboard are preferably about equal to one another.

In use, the upper face of the step is designed for a user to stand thereon. Preferably, the upper face of the step has a roughened surface 23 substantially covering the upper face of the step to frictionally enhance the upper face of the step with respect to an essentially smooth surface to help reduce a user from slipping when standing on the upper surface of the step.

Figure 2:
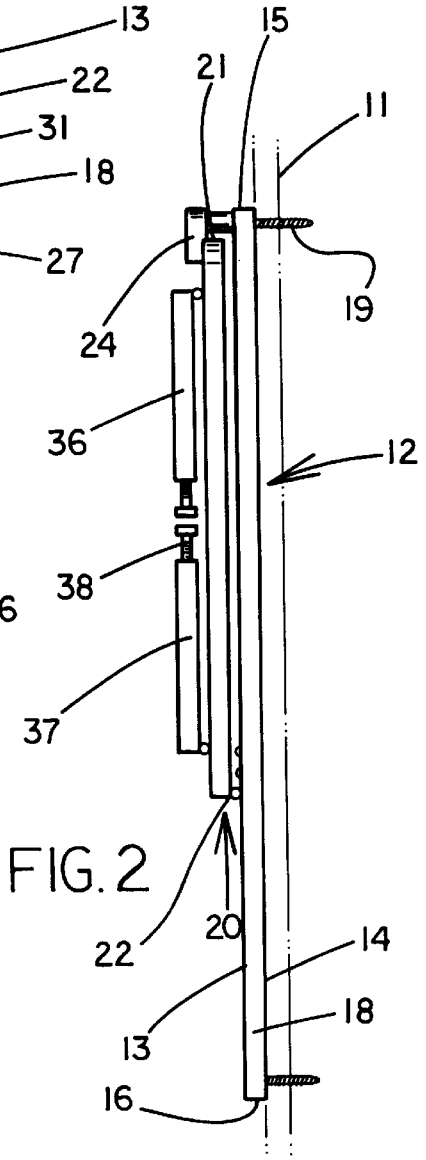
FIG. 2 is a schematic side view of the present invention with the step in the folded position.

The back end edge of the step is pivotally coupled to the front face of the backboard. The back end edge of the step is positioned between the upper and lower end edges of the backboard, the back end edge of the step is extended substantially parallel to the upper and lower end edges of the backboard. As illustrated in FIGS. 1 and 2, the step is pivotable between a deployed position (FIG. 1) and a folded position (FIG. 2) with respect to the backboard. The upper and lower faces of the step are extended substantially perpendicular to the front and back faces of the backboard and substantially horizontal to a floor surface when the step is positioned in the deployed position. When the step is positioned in the folded position, the upper and lower faces of the step are extended generally parallel to the front and back faces of the backboard and generally vertical to a floor surface.

The backboard preferably has a catch 24 pivotally coupled to the front face of the backboard adjacent the upper end edge of the backboard. In use, the catch engages the front end edge of the step to releasably hold the step to the backboard when the step is positioned in the folded position. The lower face of the step preferably has a generally rectangular mortise 25 adjacent the front end edge of the step, the mortised serving as a handle to permit the hand of a user to raise and lower the step.

Preferably, a first of the side edges of the backboard and a first of the side edges of the step generally lie in a common vertical plane and a second of the side edges of the backboard and a second of the side edges of the step generally lie in a common vertical plane.

Preferably, a pair of hinges 26,27 pivotally couple the back edge of the step to the front face of the backboard. One of the hinges is positioned adjacent the first side edges of the backboard and the step. The other of the hinges is positioned adjacent the second side edges of the backboard and the step. Each of the hinges has a pair of pivotally connected leaves 28,29. A first of the leaves of each hinge is coupled to the backboard. A second of the leaves of each hinge is coupled to the upper face of the step adjacent the back edge of the step.

Ideally, the back end edge of the step is slidable mounted to the front face of the backboard to permit sliding of the step between the end edges of the backboard along the back a vertical line extending substantially parallel to the side edges of the backboard. In this ideal embodiment, the backboard has a spaced apart pair of generally rectangular cutouts 30,31 therethrough between the front and back faces of the backboard. Each of the cutouts of the backboard has a spaced apart pair of substantially parallel side walls extending substantially parallel to the side edges of the backboard. The side walls of the cutouts each have a longitudinal ridge 32,33 extending therealong substantially parallel to the side edges of the backboard.

Figure 3:
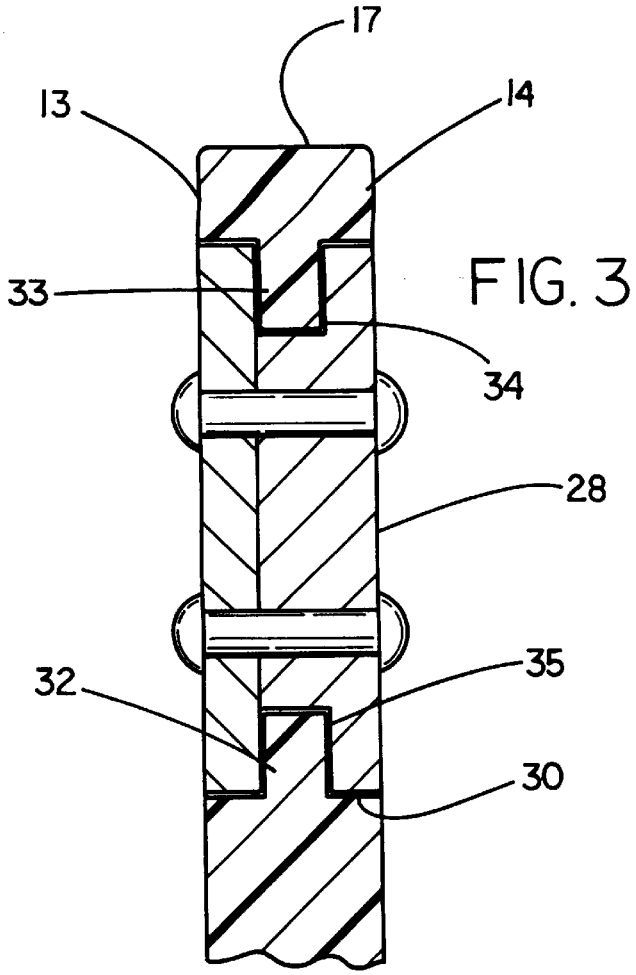
FIG. 3 is a schematic cross-sectional view taken from line 3—3 of FIG. 1.

With reference to FIGS. 1 and 3, the first leaf of a first of the hinges is positioned in a first of the cutouts of the backboard and the first leaf of a second of the hinges is positioned in a second of the cutouts of the backboard. The first leaves of the hinges each has a pair of longitudinal grooves 34,35. The longitudinal grooves of the first leaf of the first hinge slidably receive the longitudinal ridges of the first cutout to permit sliding of the first hinge along the longitudinal ridges of first cutout. Similarly, the longitudinal grooves of the first leaf of the second hinge slidably receive the longitudinal ridges of the second cutout to permit sliding of the second hinge along the longitudinal ridges of second cutout.

Generally rectangular front and back leg panels 36,37 are provided each having generally straight top and bottom edges and a pair of generally straight side edges extending between the top and bottom edges of the respective leg panel. The top edges of the leg panels are pivotally coupled to the lower face of the step. The top edge of the front leg panel is positioned adjacent the front end edge of the step and the top edge of the back leg panel is positioned adjacent the back end edge of the step. The top edges of the leg panels are preferably extended substantially parallel to the front and back end edges of the step. Ideally, a first of the side edges of each of the leg panels and the first side edge of the step generally lie in a common vertical plane and a second of the side edges of each of the leg panels and the second side edge of the step generally lie in a common vertical plane.

Figure 4:
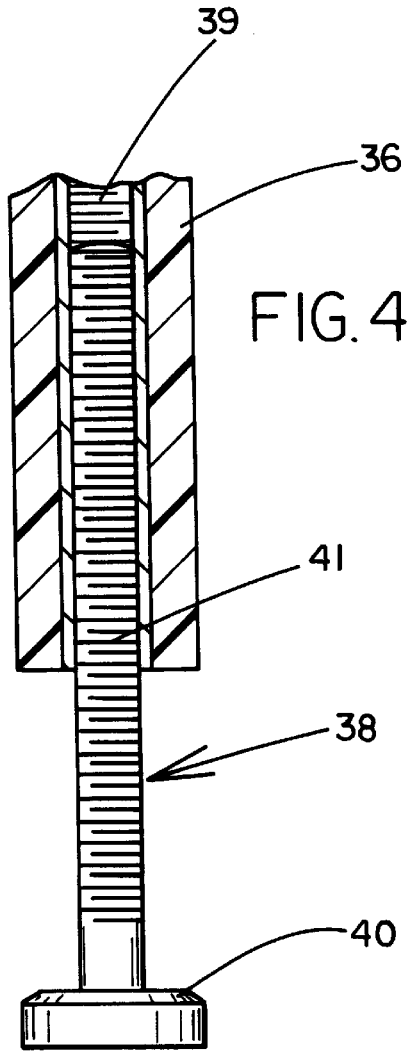
FIG. 4 is a schematic cross-sectional view taken from line 4—4 of FIG. 1.

The bottom edge of each leg panel has a spaced apart pair of adjustable feet 38 extending therefrom. The feet are designed for resting on a floor surface to support the step on the floor surface. Preferably, as best illustrated in FIG. 4, the bottom edge of each leg panel has a spaced apart pair of threaded bores 39 therein with each bore of each leg panel is associated with a corresponding foot of the respective leg panel. Each of the feet has a disk shaped grounding engaging lower portion 40 and a threaded upper portion 41 threadably inserted into the corresponding bore of the associated leg panel to permit retractable extension of the feet from the bottom edge of the associated leg panel.

Ideally, the step comprises has a hollow interior for reducing the weight of the step. In this ideal embodiment, the step, backboard, and leg panels preferably each comprise a plastic material.

In an ideal illustrative embodiment, the length of the step is about 21 inches and the width of the step is about 9 inches. In this ideal illustrative embodiment, the backboard has a length preferably between about 21 inches and about 30 inches. Ideally, the leg panels has a height defined between the top and bottom edges of the respective board of about 5 inches with the feet extendable up to about 7 inches from the bottom edge of the respective leg panel.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A step stool attachment for attachment to a substantially vertical structure, said step stool attachment comprising:

a backboard having front and back faces, upper and lower end edges, and a pair of side edges extending between said upper and lower end edges of said backboard;

said back face of said backboard being adapted for attachment to a vertical structure;

a step having upper and lower faces, front and back end edges, and a pair of side edges extending between said front and back end edges of said step;

said back end edge of said step being pivotally coupled to said front face of said backboard;

front and back leg panels each having top and bottom edges and a pair of side edges extending between said top and bottom edges of the respective leg panel;

said top edges of said leg panels being pivotally coupled to said lower face of said step, said top edge of said front leg panel being positioned adjacent said front end edge of said step, said top edge of said back leg panel being positioned adjacent said back end edge of said step;

said bottom edge of each leg panel having a spaced apart pair of adjustable feet extending therefrom;

wherein a pair of hinges pivotally couple said back end edge of said step to said front face of said backboard, each of said hinges having a pair of pivotally connected leaves, a first of said leaves of each hinge being coupled to said backboard, a second of said leaves of each hinge being coupled to said upper face of said step adjacent said back edge of said step; and wherein said back end edge of said step is slidably mounted to said front face of said backboard to permit sliding of said step between said end edges of said backboard along a line extending substantially parallel to said side edges of said backboard.

2. The step stool attachment of claim 1, wherein a plurality of fasteners are adapted for extending through said backboard and into the vertical structure to attach said backboard to said vertical structure.

3. The step stool of claim 2, wherein said backboard has four corners, and wherein each of said corners of said backboard has one of said fasteners positioned thereadjacent.

4. The step stool of claim 1, wherein said back end edge of said step is positioned between said upper and lower end edges of said backboard.

5. The step stool of claim 1, wherein said backboard has a catch pivotally coupled to said front face of said backboard adjacent said upper end edge of said backboard, said catch engaging said front end edge of said step to releasably hold said step.

6. The step stool of claim 1, wherein said lower face of said step has a generally rectangular mortise adjacent said front end edge of said step.

7. The step stool of claim 1, wherein said backboard has a spaced apart pair of generally rectangular cutouts therethrough between said front and back faces of said backboard, wherein each of said cutouts of said backboard has a spaced apart pair of substantially parallel side walls extending substantially parallel to said side edges of said backboard, wherein said side walls of said cutouts each have a longitudinal ridge extending therealong substantially parallel to said side edges of said backboard, wherein said first leaf of a first of said hinges is positioned in a first of said cutouts of said backboard, wherein said first leaf of a second of said hinges is positioned in a second of said cutouts of said backboard, wherein said first leaves of said hinges each have a pair of longitudinal grooves, wherein said longitudinal grooves of said first leaf of said first hinge slidably receive said longitudinal ridges of said first cutout to permit sliding of said first hinge along said longitudinal ridges of first cutout, and wherein said longitudinal grooves of said first leaf of said second hinge slidably receive said longitudinal ridges of said second cutout to permit sliding of said second hinge along said longitudinal ridges of second cutout.

8. The step stool attachment of claim 1, wherein said bottom edge of each leg panel has a spaced apart pair of threaded bores therein, wherein each bore of each leg panel is associated with a corresponding foot of the respective leg panel, wherein each of said feet has a disk shaped grounding engaging lower portion and a threaded upper portion threadably inserted into the corresponding bore of the associated leg panel.

9. A step stool attachment for attachment to a substantially vertical structure, said step stool attachment comprising:

a generally rectangular backboard having generally rectangular and substantially planar front and back faces, generally straight upper and lower end edges, and a pair of generally straight side edges extending between said upper and lower end edges of said backboard;

said end edges of said backboard being extended substantially parallel to one another, said side edges of said backboard being extended substantially parallel to one another and substantially perpendicular to said end edges of said backboard;

said back face of said backboard being adapted for attachment to a vertical structure such that said end edges of said backboard are generally horizontal and said side edges of said backboard are generally vertical;

wherein a plurality of fasteners are adapted for extending through said backboard and into the vertical structure to attach said backboard to said vertical structure;

said backboard having four corners, each of said corners of said backboard having one of said fasteners positioned thereadjacent;

said backboard having a thickness defined between said front and back faces of said backboard, a height defined between said end edges of said backboard and a width defined between said side edges of said backboard;

said length of said backboard being greater than said width of said backboard;

a generally rectangular step having generally rectangular and substantially planar upper and lower faces, generally straight front and back end edges, and a pair of side edges extending between said front and back end edges of said step;

said front and back end edges of said step being extended substantially parallel to one another, said side edges of said step being extended substantially parallel to one another and substantially perpendicular to said front and back end edges of said step;

said step having a thickness defined between said upper and lower faces of said backboard, a length defined between said front and back end edges of said step and a width defined between said side edges of said step;

said length of said step being greater than said width of said step;

said length of said backboard being greater than said length of said step;

said widths of said step and backboard being about equal to one another;

said upper face of said step having a roughened surface substantially covering said upper face of said step to frictionally enhance said upper face of said step;

said back end edge of said step being pivotally coupled to said front face of said backboard;

said back end edge of said step being positioned between said upper and lower end edges of said backboard, said back end edge of said step being extended substantially parallel to said upper and lower end edges of said backboard;

said step being pivotable between a deployed position and a folded position with respect to said backboard;

said upper and lower faces of said step being extended substantially perpendicular to said front and back faces of said backboard when said step is positioned in said deployed position;

said upper and lower faces of said step being extended generally parallel to said front and back faces of said backboard when said step is positioned in said folded position;

a first of said side edges of said backboard and a first of said side edges of said step generally lying in a common plane, a second of said side edges of said backboard and a second of said side edges of said step generally lying in a common plane, said backboard having a catch pivotally coupled to said front face of said backboard adjacent said upper end edge of said backboard, said catch engaging said front end edge of said step to releasably hold said step to said backboard when said step is positioned in said folded position;

said lower face of said step having a generally rectangular mortise adjacent said front end edge of said step;

wherein a pair of hinges pivotally couple said back edge of said step to said front face of said backboard;

one of said hinges being positioned adjacent said first side edges of said backboard and said step, the other of said hinges being positioned adjacent said second side edges of said backboard and said step;

each of said hinges having a pair of pivotally connected leaves;

a first of said leaves of each hinge being coupled to said backboard, a second of said leaves of each hinge being coupled to said upper face of said step adjacent said back edge of said step;

said back end edge of said step being slidably mounted to said front face of said backboard to permit sliding of said step between said end edges of said backboard along said back a vertical line extending substantially parallel to said side edges of said backboard;

said backboard having a spaced apart pair of generally rectangular cutouts therethrough between said front and back faces of said backboard;

each of said cutouts of said backboard having a spaced apart pair of substantially parallel side walls extending substantially parallel to said side edges of said backboard;

said side walls of said cutouts each having a longitudinal ridge extending therealong substantially parallel to said side edges of said backboard;

said first leaf of a first of said hinges being positioned in a first of said cutouts of said backboard, said first leaf of a second of said hinges being positioned in a second of said cutouts of said backboard;

said first leaves of said hinges each having a pair of longitudinal grooves, said longitudinal grooves of said first leaf of said first hinge slidably receiving said longitudinal ridges of said first cutout to permit sliding of said first hinge along said longitudinal ridges of first cutout, said longitudinal grooves of said first leaf of said second hinge slidably receiving said longitudinal ridges of said second cutout to permit sliding of said second hinge along said longitudinal ridges of second cutout;

generally rectangular front and back leg panels each having generally straight top and bottom edges and a pair of generally straight side edges extending between said top and bottom edges of the respective leg panel;

said top edges of said leg panels being pivotally coupled to said lower face of said step, said top edge of said front leg panel being positioned adjacent said front end edge of said step, said top edge of said back leg panel being positioned adjacent said back end edge of said step;

said top edges of said leg panels being extended substantially parallel to said front and back end edges of said step;

a first of said side edges of each of said leg panels and said first side edge of said step generally lying in a common plane, a second of said side edges of each of said leg panels and said second side edge of said step generally lying in a common plane;

said bottom edge of each leg panel having a spaced apart pair of adjustable feet extending therefrom;

said bottom edge of each leg panel having a spaced apart pair of threaded bores therein, each bore of each leg panel being associated with a corresponding foot of the respective leg panel; and each of said feet having a disk shaped grounding engaging lower portion and a threaded upper portion threadably inserted into the corresponding bore of the associated leg panel.

10. A step stool attachment for attachment to a substantially vertical structure, said step stool attachment comprising:

a backboard having front and back faces, upper and lower end edges, and a pair of side edges extending between said upper and lower end edges of said backboard;

said back face of said backboard being adapted for attachment to a vertical structure;

a step having upper and lower faces, front and back end edges, and a pair of side edges extending between said front and back end edges of said step;

said back end edge of said step being pivotally coupled to said front face of said backboard;

front and back leg panels each having top and bottom edges and a pair of side edges extending between said top and bottom edges of the respective leg panels;

said top edges of said leg panels being pivotally coupled to said lower face of said step, said top edge of said front leg panel being positioned adjacent said Front end edge of said step, said top edge of said back leg panel being positioned adjacent said back end edge of said step;

said bottom edge of each leg panel having a spaced apart pair of adjustable feet extending therefrom; and said back end edge of said step being slidably mounted to said front face of said backboard to permit sliding of said step between said end edges of said backboard along a line extending substantially parallel to said side edges of said backboard;

wherein a pair of hinges pivotally couple said step to said backboard, each of said hinges having a pair of pivotally connected leaves, and wherein said backboard has a spaced apart pair of generally rectangular cutouts therethrough between said front and back faces of said backboard, wherein each of said cutouts of said backboard has a spaced apart pair of substantially parallel side walls extending substantially parallel to said side edges of said backboard, wherein said side walls of said cutouts each have a longitudinal ridge extending therealong substantially parallel to said side edges of said backboard, wherein said first leaf of a first of said hinges is positioned in a first of said cutouts of said backboard, wherein said first leaf of a second of said hinges is positioned in a second of said cutouts of said backboard, wherein said first leaves of said hinges each have a pair of longitudinal grooves, wherein said longitudinal grooves of said first leaf of said first hinge slidably receive said longitudinal ridges of said first cutout to permit sliding of said first hinge along said longitudinal ridges of first cutout, and wherein said longitudinal groove of said first leaf of said second hinge slidably receive said longitudinal ridges of said second cutout to permit sliding of said second hinge along said longitudinal ridges of second cutout.

11. The step stool attachment of claim 10, wherein a plurality of fasteners are adapted for extending through said backboard and into the vertical structure to attach said backboard to said vertical structure.

12. The step stool of claim 11, wherein said backboard has four corners, and wherein each of said corners of said backboard has one of said fasteners positioned thereadjacent.

13. The step stool of claim 10, wherein said back end edge of said step is positioned between said upper and lower end edges of said backboard.

14. The step stool of claim 10, wherein said backboard has a catch pivotally coupled to said front face of said backboard adjacent said upper end edge of said backboard, said catch engaging said front end edge of said step to releasably hold said step.

15. The step stool of claim 10, wherein said lower face of said step has a generally rectangular mortise adjacent said front end edge of said step.

16. The step stool of claim 10, wherein a pair of hinges pivotally couple said back end edge of said step to said front face of said backboard, each of said hinges having a pair of pivotally connected leaves, a first of said leaves of each hinge being coupled to said backboard, a second of said leaves of each hinge being coupled to said upper face of said step adjacent said back edge of said step.

* * * * *